US005316857A

United States Patent [19]

Spiegel

[11] Patent Number: 5,316,857

[45] Date of Patent: May 31, 1994

[54] SHEET MATERIAL HAVING A RECOGNITION ENHANCING FEATURE

[75] Inventor: Reinhard Spiegel, Stade, Fed. Rep. of Germany

[73] Assignee: Deutsche Aerospace Airbus GmbH, Hamburg, Fed. Rep. of Germany

[21] Appl. No.: 809,669

[22] Filed: Dec. 18, 1991

Related U.S. Application Data

[63] Continuation-in-part of Ser. No. 446,309, Dec. 4, 1989, abandoned.

[30] Foreign Application Priority Data

Dec. 3, 1988 [DE] Fed. Rep. of Germany ..... 3840822

[51] Int. Cl.[5] ..... G01B 7/00; B32B 7/06

[52] U.S. Cl. ..... 428/457; 428/208; 428/328; 428/368; 428/542.8; 428/900; 324/230; 324/231; 156/64

[58] Field of Search ..... 428/328, 900, 329, 542.8, 428/367, 368, 457, 206, 208; 156/64, 378; 324/230, 231

[56] References Cited

U.S. PATENT DOCUMENTS

| | | | |
|---|---|---|---|
| 1,697,142 | 11/1925 | Roller | 428/259 |
| 3,287,197 | 11/1964 | Errede | 428/420 |
| 3,481,812 | 12/1969 | Holub et al. | 428/461 |
| 3,755,730 | 8/1973 | Vogelgesang | 324/34 R |
| 3,893,022 | 7/1975 | Kulik et al. | 324/41 |
| 4,134,538 | 1/1979 | Lagarde et al. | 235/449 |
| 4,447,492 | 5/1984 | McKaveney | 428/328 |
| 4,571,361 | 2/1986 | Kawaguchi et al. | 428/328 |
| 4,619,777 | 10/1986 | Melzer et al. | 428/328 |
| 4,644,101 | 2/1987 | Gin et al. | 428/328 |
| 4,663,214 | 5/1987 | Coburn, Jr. | 428/204 |
| 4,763,071 | 8/1988 | McGee et al. | 324/233 |
| 4,868,581 | 9/1989 | Mouri et al. | 346/1.1 |
| 4,897,300 | 1/1990 | Boehm | 428/195 |
| 5,043,032 | 8/1991 | Hunter et al. | 156/328 |

*Primary Examiner*—Ellis P. Robinson
*Assistant Examiner*—Rena L. Dye
*Attorney, Agent, or Firm*—W. G. Fasse; W. F. Fasse

[57] ABSTRACT

A sheet material in the form of a transparent film, paper sheets, or the like, is made machine visible or recognizable by recognition enhancing elements. These elements are of such a nature that they are machine readable, e.g. by optical, electrical, or magnetic sensors to increase the machine visibility of any slivers that may have remained in and/or on a prepreg or stack of prepregs. The signals sensed by photosensitive and/or magnetic and/or electric sensors are so processed that an alarm is provided when a sliver or remnant of the sheet material has been detected, and so that the location of such a sliver may be indicated.

5 Claims, 2 Drawing Sheets

SHEET MATERIAL HAVING A RECOGNITION ENHANCING FEATURE

CROSS-REFERENCE TO RELATED APPLICATION

The present application is a continuation-in-part application of my copending application U.S. Ser. No. 07/446,309, filed: Dec. 4, 1989, now abandoned.

FIELD OF THE INVENTION

The invention relates to sheet material, especially film material having a recognition enhancing feature. Such materials are used, for example, as a packing material, as a substrate, or for separating layers of fiber reinforced prepregs from one another prior to their final use in a fiber composite structure. The prepregs are sticky before they are cured. The present material prevents the stickiness from becoming effective when it is not yet supposed to be effective.

BACKGROUND INFORMATION

The storage and transport of materials that have a tendency to stick to each other and to other materials requires that so-called separator films are inserted between neighboring layers of the sticking material and that the sticky material is packed in such film material. The sticking material may, for example, comprise a plurality of so-called prepreg layers which include fiber reinforced synthetic materials in which the fibers are embedded in a resin matrix material that has not yet been cured. Once these prepregs are ready for use, for example, in the formation of an aircraft wing or the like, the separation film must be removed completely. If the separation film is not removed completely, then the resulting product does not meet the required strength characteristics and must be rejected. The complete removal of the separation film poses a problem because due to tearing of the film, portions of the film may remain on the surface of individual prepregs and such portions are undesirable because, as mentioned, they reduce the material strength of the final product.

The problem of removing the entire separation film is aggravated by the fact that the films conventionally employed are very hard to see against the background of the sticking material on which the film has been previously applied. This problem is especially aggravated when the prepregs are carbon fiber reinforced because in that case the material is black and the film is practically not visible to the naked eye against the black background.

The foregoing considerations also apply to so-called support plies or substrates which may be of the same material as the separation films, but somewhat stronger, especially stiffer, so as to provide some support for the prepreg layer prior to the curing of the matrix material so that such a prepreg material may be properly stored and transported prior to curing. Storage and transport of these materials usually takes place in the form of stacks or in the form of rolled-up bales. The separation films are primarily used for the formation of rolled-up bales, while the support plies are used for the formation of stacks of prepregs. Films and plies may also be used in combination.

The foregoing considerations also apply to packing film material that is used to envelope preformed fiber reinforced structural components, the matrix material of which has not yet been cured.

A plurality of prepregs forming a stack may be enclosed by the present material to form a package in which the individual prepreg is separated from its neighbors by separator film layers. In this type of use as a packing material it is also necessary that prior to a curing operation the protective packing film must be removed completely to obtain the intended characteristics of the finished product.

Packing material of this type is made either out of paper or synthetic materials and may be in film form. In order to improve the separating ability of the film material from the matrix material, it is known to treat the surface of the film material with a separating agent such as paraffin or the like. Conventional film material of this type is substantially transparent so that it becomes difficult to see whether the film material has been removed from the prepreg, especially whether it has been completely removed from all surface portions of the prepreg layers to be separated from one another or from the surface of a structural component. The poor visibility due to film transparency, especially when black prepregs are involved, makes it very difficult and hence time consuming to completely remove the conventional film material. As a result, it has been a problem heretofore that these film materials or portions thereof have been overlooked during inspection so that film or film portions become part of the structure into which the prepregs are integrated. Due to the separating effect of the film material the structure becomes a reject.

The need for the complete removal of the packing film has been recognized heretofore. However, the conventional practice for such removal is to provide lists of all individual film sections and these lists must be checked by the operator against the removed film material, whereby an incompletely checkable list indicates that respective portions of film materials have gone undetected. Thus, additional visual inspections were necessary prior to the invention, even after the films have been removed. Such subsequent inspections are also very difficult due to the lack of suitable contrast conditions between the transparent film and the packaged or separated material. Another disadvantage of the conventional approach to solving this problem is the fact that visual inspections by a human operator are not very suitable for integration into a substantially automated manufacturing operation.

The foregoing problem is further aggravated when prepreg layers in the form of precut blanks have been separated from the separator film and layered to form the structural component. If, in such a case, pieces of separator film remain inside the layered structure, such separator film pieces cannot be detected at all by conventional means.

OBJECTS OF THE INVENTION

In view of the above it is the aim of the invention to achieve the following objects singly or in combination:

to provide a sheet material suitable for the above purposes, in the form of sheet material including synthetic film, which will avoid the above problems by providing a machine readable contrast between the material and the packaged or separated prepregs, so that the presence of remaining pieces of sheet material can be recognized even if there is no contrast visible to the human eye;

to provide machine readable contrast enhancing elements in or on the surface of the sheet material, which elements can be recognized by an electrical or magnetical sensor even if remaining pieces of sheet material are hidden inside a stack of already layered prepreg blanks, for an improved integration into a fully automated manufacturing process or system; and to enable the early recognition of ripped off portions of the sheet material in or on the prepreg so that the removal of such portions can be quickly accomplished.

SUMMARY OF THE INVENTION

The above objects have been achieved according to the invention by a sheet material in the form of a film, ply, or substrate of synthetic material, paper, or the like, into or onto which machine recognition enhancing elements have been integrated as part of the sheet material for recognizing its presence on the surface or even inside of packaged prepregs or a preformed structural component made of fiber-reinforced composite material of which the matrix has not yet been cured, wherein the sheet material serves as a separating or protecting means.

It is a special advantage of the sheet material of the invention that it becomes machine recognizable not only on the outer surfaces or on cut edges of preformed structural elements or precut stocked prepregs that are made ready for curing, but also inside of these elements and stacks. In other words, the sheet material or portions thereof become machine "visible" even if small slivers still stick to an edge or inside of a structural element or stack, namely between layers of prepregs, for example. This feature greatly enhances the ability to remove the film material prior to the final use prepreg material so as to avoid producing rejects.

By providing the sheet material with aluminum or graphite flakes, particles, fibers, or the like, an eddy current sensor may be used for the machine scanning. By providing the sheet material with a magnetically recognizable material, a magnetic sensor may be used for the machine scanning.

The use of machine readable recognition enhancing elements has the advantage that any respectively sensed or generated signal can be converted into an acoustical or other warning signal to alert an operator.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
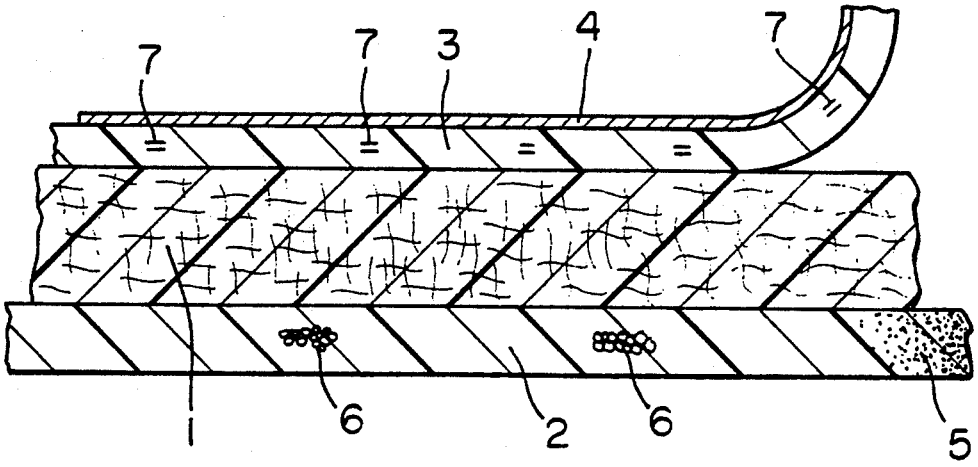
FIG. 1 shows a sectional view through a laminated fiber composite property material according to the invention laminated to separating sheet material.

FIG. 1 shows a fiber composite material according to the invention including a prepreg material 1, in the form of a fiber-reinforced layer, the matrix material of which has not yet been cured. The fibers may be carbon fibers which give the prepreg a black appearance. The downwardly facing surface of the prepreg 1 is supported by a separator support ply 2 according to the invention. The upwardly facing surface of the prepreg 1 is covered by a separating film 3 according to the invention. The separator film 3 has at least one smooth surface for temporarily neutralizing the stickiness of said uncured matrix material. The support ply 2 is sufficiently stiff for its support function. The film 3 is rather thin and just sufficient in its thickness to separate the prepreg 1 from another prepreg stacked on top of the separating film 3 with its metal coating 4. The metal coating may be a very thin aluminum film that makes the film 3 or slivers thereof machine readable by an eddy current sensor. Such sensors are known.

Due to the protective or support ply 2 and the separator film 3, the prepregs can be stacked. By replacing the support ply 2 by another film 3, a plurality of prepregs can be rolled up to form a roll or bale. The surface of the support ply 2 and the film 3 facing the prepreg is very smooth to assure an easy separation just prior to the actual use of the prepregs. Incidentally, although the support ply 2 may be somewhat thicker than the film 3, it is still sufficiently flexible that even with the support ply 2 rolling of a plurality of prepregs into a roll is possible. In any event, the ply 2 and the film 3 prevent that the prepreg material of one layer comes into contact with the prepreg material of another layer. Such contact must be prevented because it is then virtually impossible to effectively separate the two from one another even before curing.

According to the invention the support ply 2 and the film 3 are provided with machine readable recognition enhancing elements to facilitate the finding of the film or ply or even tiny ripped-off slivers thereof. Recognition is possible even along an edge of the sheet material without an actual surface view and even if a sliver remained inside a stack of prepreg blanks.

The recognition enhancing element or elements may be present in the form of a metal coating 4, for example, an aluminum coating, applied by vapor deposition, to be read by an eddy current sensor.

Magnetically sensible particles, such as iron powder 5, may be embedded in the material of the ply 2 and/or the film 3. The particles 5 may also change the contrast pattern of the sheet material relative to the prepreg 1.

Fine gas bubbles 6 embedded in the packing material impart a whitish appearance in the areas where the bubbles are present. This whitish appearance enhances a contrast visible by the naked eye, but the presence of such bubbles may also be machine readable in that the bubbles can change an electrical or magnetic field. Preferably, the recognition enhancing elements are arranged throughout the surface area of the sheet material and different types of such enhancing elements may be combined with each other.

Electrically and/or magnetically responsive metal flakes 7 are embedded in the sheet material and the color of these flakes 7 also increases the visible contrast of the ply 2 and/or film 3. The flakes, in addition to being electrically and/or magnetically responsive, may also have a luminescence to be visible under daylight conditions. The luminescence even increases the contrast as compared to a regular coloring pigment or dye.

By providing a coloring agent with a fluorescent effect, for example, in response to ultraviolet incident radiation on the ply or film, it is possible to provide a reflection in the visible or other spectral range so that the ultraviolet incident illumination makes the brightly reflecting film or ply edges well visible, and also machine readable. Optical sensors may be used for the machine reading for the presence of slivers of the ply 2 or film 3 so that the inspection may be easily integrated into a fully automated production process. The selectively responsive sensors are not disturbed by any incident ultraviolet light.

Figure 2:
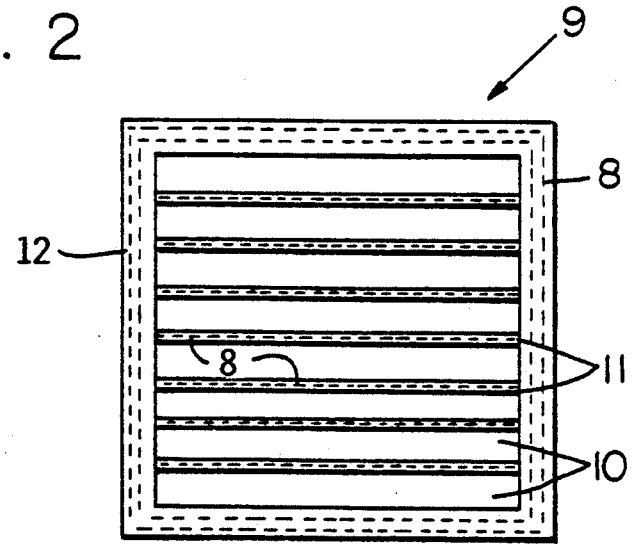
FIG. 2 is an end view onto a stack of prepregs separated and wrapped by the present separating sheet material.

A magnetic readability may also be achieved by incorporating magnetic particles 8 or the like into the present sheet material, such as paper having at least one smooth surface to face a stack of prepregs. FIG. 2 shows a wrapped stack 9 of prepregs 10 separated by film layers 11 having magnetically readable particles 8 therein. The stack 9 is enveloped by sheet material 12 according to the invention. These particles 8 are selected from iron dust, nickel dust, or ferrite powder, for example. In this embodiment it is possible to ascertain the presence of the packing material by means of magnetic probes which are responsive to the differences in the magnetic conductance of the material near the probe.

Figure 3:
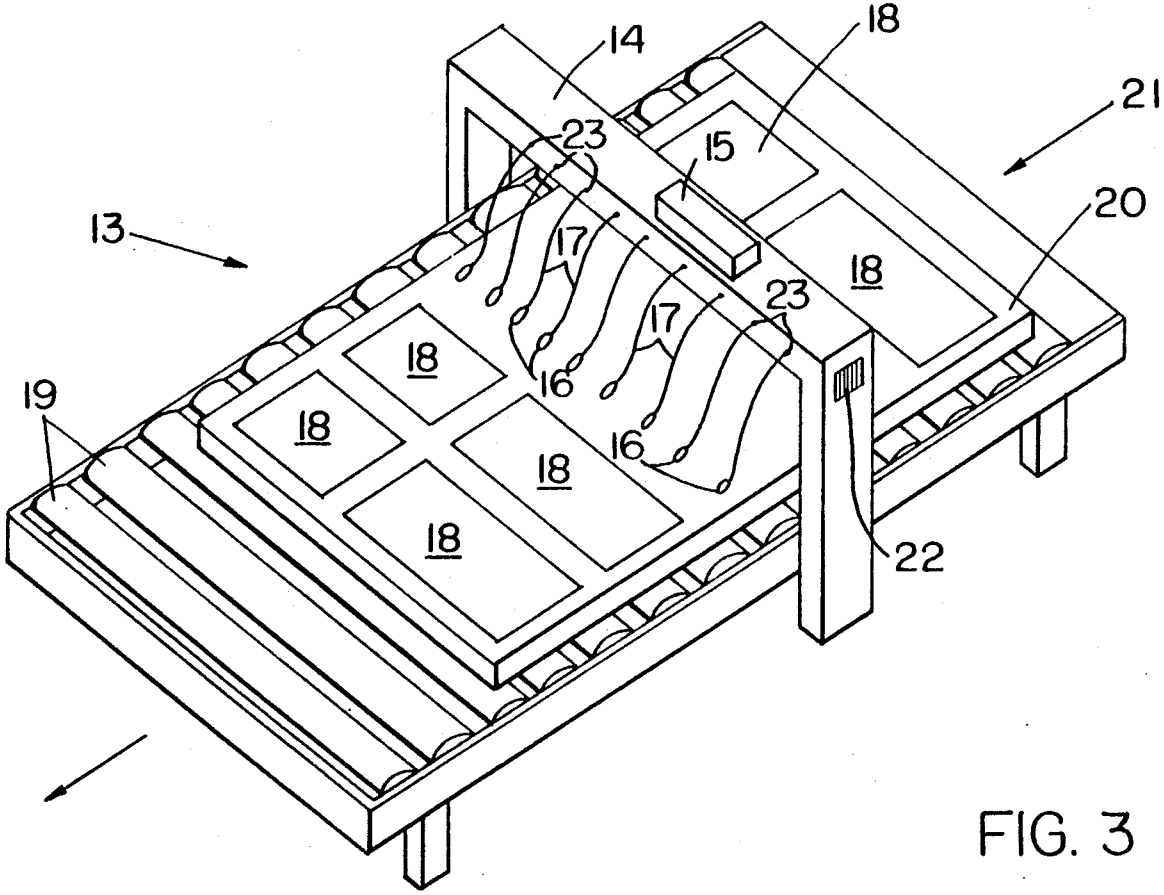
FIG. 3 is a perspective view of an inspection station for signalling the presence of separating sheet material remainders.

FIG. 3 shows a checking or sensor station 13 with a gantry 14 carrying an electronic circuit 15 for processing electrical signals sensed by magnetic probes or sensors 16. These probes 16 are, for example, attached to the ends of so-called drag sensor cables 17 which are suspended from a portal or gantry 14 and move over the surface of the precut prepreg blanks 18. The magnetic sensors, or rather probes 16, may be stationary while the prepregs 18 pass under the probes 16, for example, on a conveyor 19, such as a roller conveyor 19. However, the probes may also be movable while the prepregs are stationary. The presence of a film or film sliver on the surface of a prepreg or inside a stack of prepregs on a pallet 20 passing over the converyor rollers 19 in the direction of the arrow 21, is sensed and made known to an operator by an acoustical warning signal through a loudspeaker 22. The respective detector circuit 15 can also provide an instruction signal for the automatic removal of a faulty prepreg layer out of a manufacturing assembly line and for its transport to a repair station. Lightbulbs 23 are provided in the gantry to designate the respective cable 17 and sensor 16. Thus, the operator also gets an indication of the location of a sliver in any particular prepreg blank 18. The circuit 15 processes all sensed signals to operate the speaker, the correct lightbulb 23, and may even provide a stop signal for stopping a motor that drives the rollers 19. In this manner, the probe 16 would come to rest substantially on a spot where a sliver has been detected.

Optically machine sensible, visible, and magnetically and electrically machine sensible elements may be used in combination as shown. Thus, the machine inspection can be supplemented by a visual inspection and vice versa.

Although the invention has been described with reference to specific example embodiments, it will be appreciated that it is intended to cover all modifications and equivalents within the scope of the appended claims.

What I claim is:

1. An article of manufacture comprising a separator sheet material (2,3) and a fiber composite prepreg material (1) of a still uncured resin matrix material having reinforcing fibers embedded therein, said separator sheet material (2,3) contacting at lease one surface of said fiber composite material, said separator sheet material (2, 3) having at least one smooth surface for temporarily neutralizing the stickiness of said uncured matrix material, said separator sheet material (2, 3) comprising magnetically sensible metal means as part of said separator sheet material for recognizing the presence of remainders of said separator sheet material on or in said fiber composite material.

2. The fiber composite material of claim 1, wherein said magnetically sensible metal means comprise magnetic metal flakes (7) or particles (8).

3. The fiber composite material of claim 2, wherein said magnetically sensible flakes or particles are selected from the group consisting of iron, nickel, and ferrite.

4. The fiber composite material of claim 1, wherein said magnetically sensible means provide electrical output signals.

5. The fiber composite material of claim 1, wherein said reinforcing fibers are black carbon fibers.

* * * * *

UNITED STATES PATENT AND TRADEMARK OFFICE

CERTIFICATE OF CORRECTION

PATENT NO. : 5,316,857

DATED : May 31, 1994

INVENTOR(S) : Reinhard Spiegel

It is certified that error appears in the above-indentified patent and that said Letters Patent is hereby corrected as shown below:

Title page,

In [56] line 2, replace "11/1964" by --11/1966--.

In [56] add the following reference:

--4,876,153 10/1989.....Thurfinnson--.

Claim 1, col. 6, line 23, replace "lease" by --least--;

col. 6, line 24, after "composite" insert --prepreg--;

col. 6, line 26, after "uncured" insert --resin--;

col. 6, line 31, before "material" insert --prepreg--, after "material" insert --after said separator sheet material has been removed--.

Claim 2, col. 6, line 32, replace "The fiber composite material" by -- An article of manufacture--.

Claim 3, col. 6, line 35, replace "The fiber composite material" by -- An article of manufacture--.

Claim 4, col. 6, line 38, replace "The fiber composite material" by -- An article of manufacture--.

Claim 5, col. 6, line 41, replace "The fiber composite material" by -- An article of manufacture--.

Signed and Sealed this

Twentieth Day of September, 1994

*Attest:*

*Attesting Officer*

Bruce Lehman

BRUCE LEHMAN

*Commissioner of Patents and Trademarks*